United States Patent [19]

Bickley

[11] 4,020,429

[45] Apr. 26, 1977

[54] HIGH POWER RADIO FREQUENCY TUNABLE CIRCUITS

[75] Inventor: Robert Henry Bickley, Scottsdale, Ariz.

[73] Assignee: Motorola, Inc., Chicago, Ill.

[22] Filed: Feb. 12, 1976

[21] Appl. No.: 657,665

[52] U.S. Cl. ..... 333/73 R; 333/33; 333/73 S; 333/84 M; 333/84 R

[51] Int. Cl.[2] ..... H01P 1/20; H01P 7/00; H01P 3/08; H01P 5/04

[58] Field of Search ..... 333/73 S, 84 M, 84 R, 333/73 R, 31 R, 73 W, 24.1, 24.2, 32–35; 331/99, 107 G, 107 R; 334/4, 41–42

[56] References Cited

UNITED STATES PATENTS

| | | | |
|---|---|---|---|
| 3,448,409 | 6/1969 | Moose et al. | 333/84 X |
| 3,671,888 | 6/1972 | Szente et al. | 333/73 S |
| 3,681,716 | 8/1972 | Chiron et al. | 333/73 S |
| 3,766,494 | 10/1973 | Anbe et al. | 331/99 |
| 3,875,538 | 4/1975 | Minet et al. | 333/73 S |
| 3,882,420 | 5/1975 | Liu | 333/84 M X |

OTHER PUBLICATIONS

Harvey–"Microwave Engineering" Academic Press New York, 1963; title page and pp. 8–9.

*Primary Examiner*—Alfred E. Smith
*Assistant Examiner*—Marvin Nussbaum
*Attorney, Agent, or Firm*—M. David Shapiro

[57] ABSTRACT

A high power tunable radio frequency circuit which may be used, for example, in a power oscillator, frequency discriminator, diplexer, filter, or a multicoupler comprising a stripline distributed circuit in the influence of a variable magnetic field introduced orthogonally to the plane of the stripline circuit. The stripline is laminated between two layers of planar ferrite members and the D.C. magnetic field intensity is varied to bias the material to a predetermined but variable permeability level, thus changing the propagation velocity of the R.F. signal in the stripline and, therefore, acting to tune the device. Alternately, a microstrip embodiment may be employed utilizing a planar ferrite substrate on one side of the circuit configuration only.

6 Claims, 15 Drawing Figures

HIGH POWER RADIO FREQUENCY TUNABLE CIRCUITS

FIELD OF THE INVENTION

The invention relates to the use of magnetically biased ferrite substrates in the radio frequency field of a stripline or microstrip filter or other high frequency circuit accomplishing tuning of the circuit device by controlling the substrate permeability.

BACKGROUND OF THE INVENTION

In electronic applications where tunable, high power, frequency determining elements are needed, the requirements have been filled in a number of ways, each presenting some problems. A series of fixed tuned devices have been used; frequency selection being accomplished by switching from one to another. Where high speed tuning is a requirement, mechanical switches are not fast enough and the switched elements may suffer from radio frequency high voltage break down at higher power levels. Pin diode electronic switches are faster, but introduce losses. Switched resonator schemes become complex and bulky when designed to cover wide tuning ranges. Mechanical tuning of lumped constant elements by operation of an electric motor is too slow in many applications. Since the use of any kind of mechanical tuning technique is generally associated with lumped contant tunable elements, the potential high voltage breakdown characteristics of the lumped constant elements are likely to be a limitation in high power tuned circuits.

Ferromagnetic resonate mode yttrium-iron-garnet (YIG) tuned filters and oscillators have been used for limited power requirements where relatively simple circuits are required; for example, single resonator narrow bandpass filters vs. multi-resonator, arbitrary bandwidth designs. These designs are generally limited in operation to frequencies above one-half gigahertz.

Varactor tuned filters and oscillators have also been built, but they too are limited to low power applications and losses are generally high. The Q and tuning range of varactor tuned devices are also limited at high frequencies.

A system utilizing a variable permeability substrate for tuning a cooperating stripline inductive element has been developed for use in high frequency, high power amplifiers. The variable inductance is associated with a remotely located capacitive element for establishment of a resonant frequency load for the amplifier. This system provides very fast tuning of the amplifier load by adjustment of the static magnetic field in the substrate. The magnetic field is electrically adjusted to provide the desired permeability within the ferrite substrate, thus changing self-inductance of the strip-line to accomplish tuning thereof. This system is not very suitable for use in filter circuits because of the physical difficulties in making electrical connections between the necessary pluralities of inductances and capacitances. The system also suffers from having to withstand relatively high levels of RF voltages in the lumped constant capacitive elements. Further, it is very difficult to accomplish desired RF coupling between the various elements of filters fabricated in this manner so that it becomes impractical to build anything but the most rudimentary kind of filter using this technique and those that are made this way are severely limited in power handling capability.

SUMMARY OF THE INVENTION

These and other problems and shortcomings of the prior art are resolved by the instant invention by utilizing a ferrite substrate or substrates to control the magnetic permeability adjacent to or surrounding a stripline or micro-strip tunable element. The use of a ferrite substrate such as yttrium-iron-garnet (YIG) with a relatively broad range of adjustment of permeability provides a broad range of tunability in fabricated devices, such as electrical filters. By keeping the useful range of magnetic permeability low with respect to the fixed value of the dielectric constant of the substrate, the coupling between circuit elements remains essentially constant over the tuning range. This means that in an electrical filter embodiment of the invention, for instance, the bandwidth of the filter remains essentially constant over a very wide tuning range. Since the radio frequency impedance levels are low, the invention provides relatively low radio frequency voltage levels in the device and electrical breakdown problems are reduced even at very high power levels. Tuning rates are limited only by the ability to provide quick response time in the magnetic circuit which biases the ferrite substrate which in turn provides variable permeability.

According to one aspect of the invention, all of the elements of a tunable electronic circuit, such as an electronic filter, are fabricated in microstrip form and placed on a ferrite substrate for providing a fixed dielectric constant and a variable magnetic permeability factor for tuning the circuit.

According to another aspect of the invention, all of the elements of a tunable electronic circuit, such as an electronic filter, are fabricated in strip-line form and placed between two ferrite substrates for providing a fixed dielectric constant and a variable magnetic permeability factor for tuning the circuit.

According to still another aspect of the invention, a biasing magnetic field is utilized to control and establish the magnetic permeability of ferrite substrates in the electrical field of a complex tunable planar circuit for the purpose of tuning the circuits without materially affecting the bandwidth of the circuit.

According to yet another aspect of the invention, a complex tunable radio frequency circuit is contained on or between ferrite substrates and the tuning of the circuit is accomplished by electrically controlling the magnetic permeability of low loss ferrite substrates. The electric field intensity and the power losses in the circuit are kept relatively low by this choice of material and structural configuration so that the power handling capability of the apparatus is relatively high.

According to a still further aspect of the invention, extended feed line lengths are serially interposed to inductively or capacitively load the terminals of the device of the invention, thereby frequency compensating the external load applied to still further extend the frequency tuning range of the tuned circuit.

The invention will be better understood by referral to the drawings and the detailed description of the invention which follows.

Figure 1:
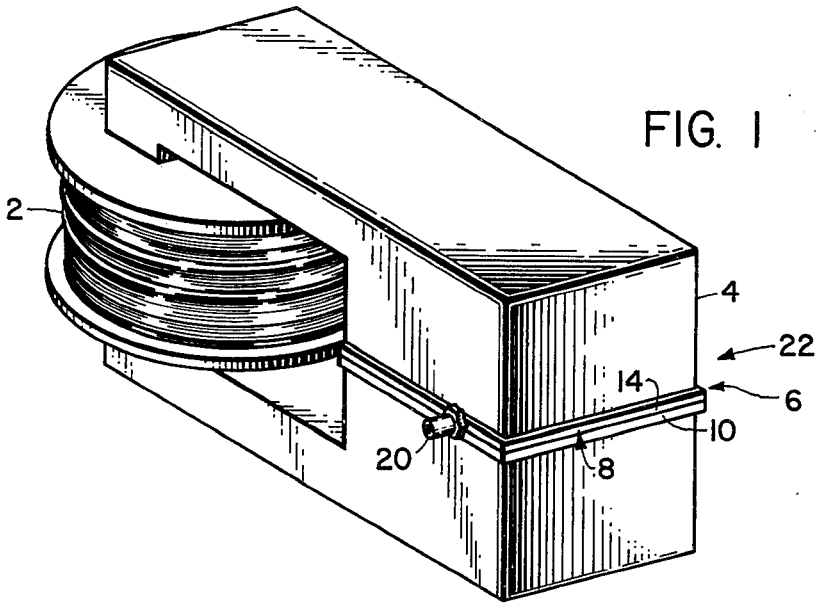
FIG. 1 illustrates a typical embodiment of the invention including a magnetic circuit and a tunable electrical circuit mounted therein between two ferrite substrates.
Figure 3A:
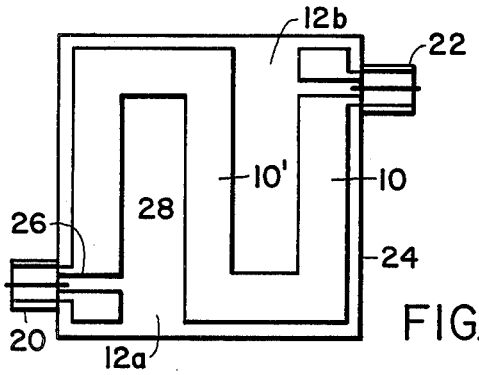

FIG. 3*a* illustrates one embodiment of a planar bandpass filter circuit of the grounded class which may be used in the invention of FIG. 1.

Figure 3B:
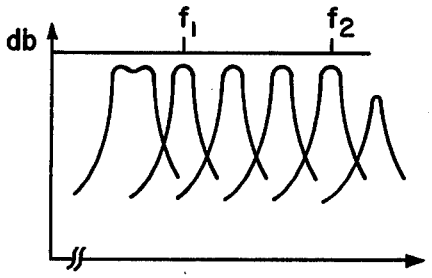

FIG. 3*b* shows the electrically tunable bandpass characteristics of the filter of FIG. 3*a* in graph form.

Figure 4A:
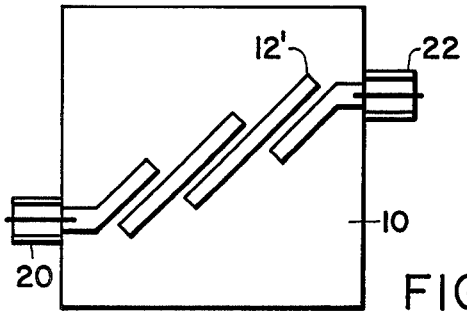

FIG. 4*a* illustrates another embodiment of a planar bandpass filter circuit of the ungrounded class which may be used in the invention of FIG. 1.

Figure 4B:
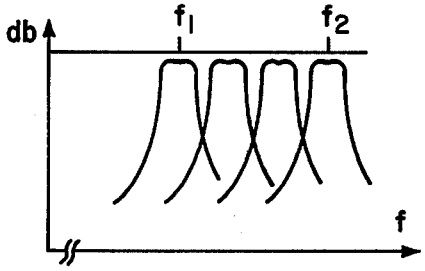

FIG. 4*b* shows the electrically tunable characteristics of the bandpass filter of FIG. 4*a* in graph form.

Figure 5A:
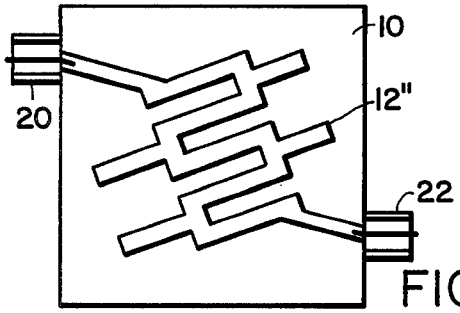

FIG. 5*a* illustrates still another embodiment of a planar band-stop filter circuit of the ungrounded class which may be used in the invention of FIG. 1.

Figure 5B:
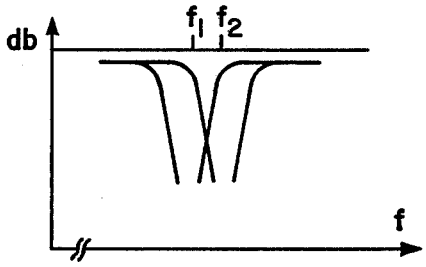

FIG. 5*b* shows the electrically tunable characteristics of the bandstop filter of FIG. 5*a* in graph form.

Figure 6A:
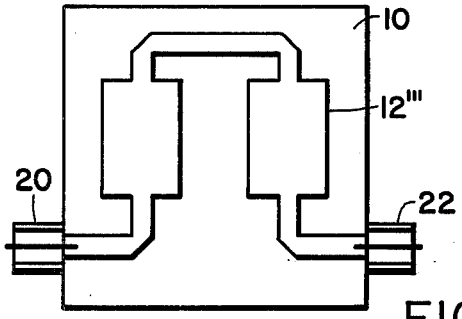

FIG. 6*a* illustrates yet another embodiment of a planar low pass filter circuit of the ungrounded class which may be used in the invention of FIG. 1.

Figure 6B:
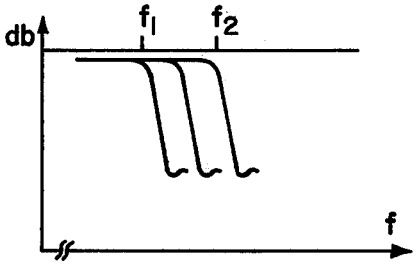

FIG. 6*b* shows the electrically tunable characteristics of the filter of FIG. 6*a* in graph form.

Figure 7A:
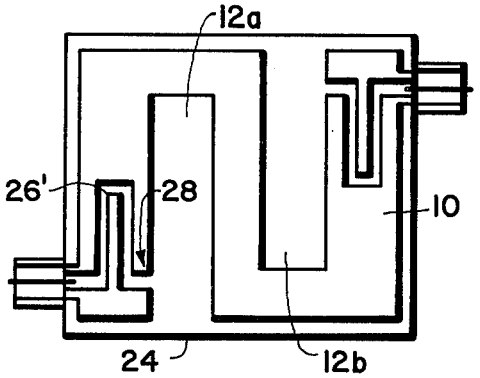

FIG. 7*a* illustrates an improved embodiment of the bandpass filter of FIG. 3*a* utilizing extended feedline length.

Figure 7B:
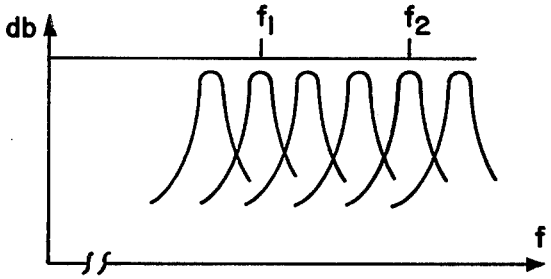

FIG. 7*b* shows the improved electrically tunable characteristics of the improved bandpass filter of FIG. 7*a* in graph form.

Figure 8:
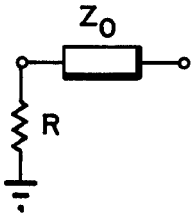

FIG. 8 illustrates schematically the equivalent electrical feed circuit for the filter of FIG. 7*a*.

Figure 9:
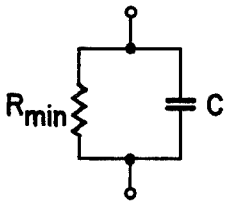

FIG. 9 illustrates schematically the equivalent circuit of FIG. 8 at a frequency at the high end of the tunable range.

Figure 10:
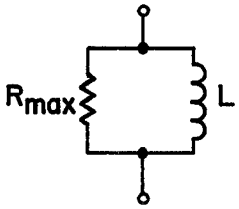

FIG. 10 illustrates schematically the equivalent circuit of FIG. 8 at a frequency at the low end of the tunable range.

DETAILED DESCRIPTION OF THE INVENTION

Referring to FIG. 1, the reader will see there illustrated the preferred embodiment of the invention. Electromagnet coil 2 provides a magnetic field source for magnetic core 4. A variable current source (not shown) may be used to drive electrical current through coil 2 and by varying the level of the current, the magnetic field intensity in core 4 may be varied. Magnetic core 4 has air gap 6 into which assembly 8 is inserted.

Figure 2:
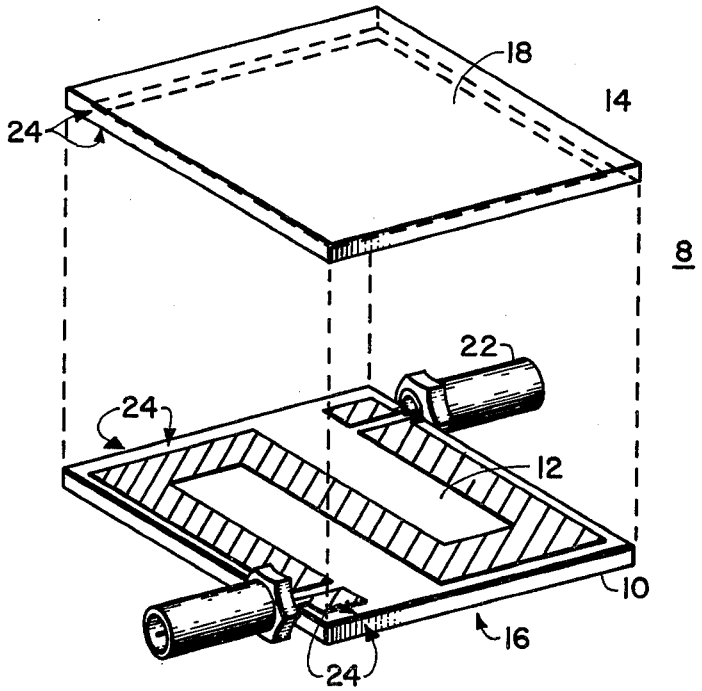
FIG. 2 illustrates an exploded view of the ferrite substrates and planar electrical circuit of FIG. 1.

Laminated assembly 8 is illustrated in exploded view, FIG. 2. It comprises planar ferrite substrate 10 which may be made of yttrium-iron-garnet (YIG), strip-line circuit 12, which may be disposed upon substrate 10 and bonded thereto, or, alternately, disposed on a thin film of dielectric material (not shown) and placed in close proximity to substrate 10. In either case, ferrite substrate 14, which also may be made of YIG material, covers strip-line circuit 12 and forms the third layer of laminated assembly 8. The lower side of substrate 10 and the upper side of substrate 14 have disposed thereon thin nonmagnetic ground planes 16, 18 which may be made of copper, for example.

Laminated assembly 8 may be either of two classes: a grounded class, a typical circuit of which is illustrated in FIG. 3*a*, or, an ungrounded class, typical circuits of which are illustrated in FIGS. 4*a*, 5*a* and 6*a*. In the grounded circuit class, circuit 12 is electrically connected to ground planes 16, 18 by nonmagnetic conductor depositions on the edges of substrates 10, 14. In the ungrounded class circuits, typical embodiments of which are illustrated in FIGS. 4*a*, 5*a* and 6*a*, circuits 12′, 12″ and 12‴ are not connected to ground planes 16 (or 18, not shown in FIGS. 4*a*, 5*a* and 6*a*).

When laminated assembly 8 is installed in air gap 6 (see FIG. 1), ground planes 16, 18 are interconnected by virtue of the common connections to the outer conductors of coaxial connectors 20, 22, Center conductors of coaxial connectors 20, 22 are connected to the input and output, respectively, of circuit 12. In the grounded class of circuit 12, there is also an electrical connection made between ground planes 16, 18 by virtue of the edge conductors on substrates 10, 14 and the close contact therebetween caused by insertion of assembly 8 into air gap 6.

Alternately, only one substrate may be used in microstrip configuration, not shown. When a micro-strip structure is used, upper substrate 14, of FIG. 2, is not used and when the micro-strip circuit assembly is inserted into air gap 6 it becomes important to prevent the face of magnetic core 4 from contacting and electrically shorting the exposed face of circuit 12. This may be accomplished by any suitable insulating means including a small air space provided therebetween.

FIG. 3*a* illustrates a top view of strip-line filter circuit 12 as shown in FIG. 2. The center conductor of coaxial connector 20 feeds circuit element 12*a* which is also electrically connected by means of edge conductor 24 to ground plane 16 (not shown) on the lower side of substrate 10. Circuit 12*a* is electrically, mutually coupled to circuit 12*b* across bare substrate portion 10′. Circuit 12*b* is also electrically connected, by means of edge conductor 24 to ground plane 16 (not shown). This configuration is typical of the "grounded" class of strip line circuits which utilize a resonator grounded at one end. The outer or ground conductors of coaxial connectors 20, 22 are also connected to ground plane 16 and (when used) to ground plane 18 of upper substrate 14 (see FIGS. 1 and 2). The center conductor of coaxial connector 22 is electrically connected to circuit 12*b*. When used in stripline configuration, the filter of FIG. 3*a* is used with a covering substrate, such as substrate 14, shown in FIG. 2 and edge conductors 24 are placed in close contact to complete a nearly continuous electrical connection between ground planes 16 and 18.

A second, or "ungrounded" class of stripline circuit may be used, alternately, as typified by the illustrations of FIGS. 4*a*, 5*a* and 6*a*. While the substrates shown in each of FIG. 4*a*, 5*a* and 6*a* also utilize a ground plane, similar to ground plane 16 of FIG. 2, there are no connections from the ground plane to cicuits 12′, 12″ and 12‴ (FIGS. 4*a*, 5*a* and 6*a*, respectively). Edge conductors 24, as shown in FIG. 2, are not necessary to the proper operation of the ungrounded class of circuits as typified by FIGS. 4*a*, 5*a* and 6*a*. In stripline configurations, the ungrounded class circuits are covered by a second substrate, such as substrate 14, FIG. 2. Ground planes 16, 18 are interconnected by reason of their common connections to the outer conductors of coaxial connectors 20, 22 (see FIGS. 1 and 2) and while edge conductors 24 may be used to enhance the electrical interconnection of ground planes 16, 18 it is not necessary to the proper operation of the ungrounded class circuits.

As in the case of grounded class circuits, such as that of FIG. 3*a*, ungrounded class circuits, such as those of FIGS. 4*a*, 5*a* and 6*a* may be used in microstrip configuration, that is, without the use of upper substrate 14 as in FIGS. 1 and 2.

While all of the circuits depicted in FIGS. 3*a*, 4*a*, 5*a* and 6*a* are tunable filter circuits of one sort or another, the present invention is in no way limited to filter circuits. Tunable radio frequency circuits of other types utilizing resonant printed elements are also capable of fabrication in accordance with the teachings herein, as will be well understood by one skilled in this art. A better understanding of the principles of the invention, as applied to any tunable radio frequency circuit, may be illustrated by the following description of the operation of the filter circuits of FIGS. 3*a*, 4*a*, 5*a* and 6*a* when incorporated into the invention as depicted in FIG. 1.

It is essential to the principles of the invention that substrates 10, 14 of FIGS. 1 through 7 be made of a material such as YIG ferrite biased at a high magnetic field intensity above its saturating value offering controllably variable magnetic permeability. The YIG material used in the preferred embodiment described herein may typically have a range of permeability of from 2 to 18 and is controllable by varying the intensity of the magnetic field orthogonal to the planar surfaces of the substrates. This is accomplished in the present invention by varying the D.C. current level in coil 2 of FIG. 1. This, in turn, causes the magnetic field intensity in coil 2, in magnetic core 4, and thus, in assembly 8, mounted in air gap 6, to vary. The dielectric constant of the YIG substrates 10, 14 is approximately 15. This dielectric constant does not vary with the imposed magnetic field intensity. As the magnetic field intensity is increased in substrates 10, 14, the magnetic permeability is reduced. As permeability is reduced, the radio frequency propagation velocity in the substrate (YIG) material increases according to the formula:

$$Vp = (\mu\epsilon)^{-1/2}$$

where $Vp$ = propagation velocity, relative to free space,
$\mu$ = magnetic permeability relative to free space, and
$\epsilon$ dielectric constant relative to free space.

The nominal center frequencies of the circuits of FIGS. 3*a*, 4*a*, 5*a* and 6*a* vary linearly with an increase in $Vp$. Since $\epsilon$ is a constant not subject to change in a variable magnetic field, resonant frequency is an inverse square root function of magnetic permeability in substrates 10, 14. When magnetic permeability is nearly equal to dielectric constant, the resonator coupling and therefore bandwidth of circuits 12 varies with magnetic field intensity. However, when magnetic permeability is much smaller than the dielectric constant, coupling (and bandwidth) remain essentially constant with changes in magnetic field intensity. Therefore design and operation is preferably at higher levels of magnetic intensity (lower values of magnetic permeability) in those circuits where constant coupling (and thus, bandwidth) is desirable. Typical operating characteristics of the filters of FIGS. 3*a*, 4*a*, 5*a* and 6*a* are shown graphically in corresponding FIGS. 3*b*, 4*b*, 5*b* and 6*b*.

The grounded class filter circuit of FIG. 3*a* yields operating characteristics according to those portrayed in the graph of FIG. 3*b*. With a relatively low magnetic field intensity (low d.c. magnetic biasing current in coil 2, FIG. 1), magnetic permeability in substrates 10, 14 is relatively high and the nominal frequency, $f1$, of the circuit of FIG. 3*a* is relatively low, as shown in FIG. 3*b* at $F_1$. Circuit 12 of FIG. 3*a* provides a relatively narrow bandpass filter characteristic as shown in FIG. 3*b*, which may be on the order of 1% of the nominal frequency. As the magnetic field intensity is increased by increasing the d.c. bias current in coils 2 of FIG. 1, the nominal frequency of filter circuit 12 (FIG. 3*a*) responds by moving upward to $f_2$, as shown in FIG. 3*b* due to a shift in resonant frequency of resonators 12*a* and 12*b*. The reader should note that the filter of FIG. 3*a* (as shown in FIG. 3*b*) may be tuned over the range of from $F_1$ to $F_2$ without significantly affecting the bandpass and loss characteristics. FIG. 3*b* also shows, however, that at a frequency above $F_2$, bandwidth is reduced and insertion loss increased. At a frequency below $F_1$, bandwidth increases and insertion loss also increases, at the nominal center frequency. While the range from $F_1$ to $F_2$ represents a relatively wide frequency ratio, it will be understood that in some applications, even wider tuning ranges may be desirable without the attendant degradation shown in FIG. 3*b*. The degradation may be better understood by inspection of FIG. 3*a*. Feedline 26 intersects resonator 12*a* at point 28, near the grounded end of resonator 12*b*. Since the impedance of any point on resonator 12*b* is higher as the point is moved away from the grounded end, point 28 may be selected to provide a good impedance match with feedline 26 and the source or sink impedance external to the circuit. Typically, the characteristic impedance of feedline 26 is selected to match the external source or sink impedance, generally a pure resistive value. Point 28 is then selected to provide an optimum coupling impedance to resonator 12*a* at the center of the tunable frequency range of the device for best transfer of power. As the frequency of the device is changed by tuning; that is, by changing the bias current in coil 2 of FIG. 1; the electrical coupling coefficient between resonators 12*a* and 12*b* changes causing the filter bandwidth to change. This is true since the energy coupled from resonator 12*a* to resonator 12*b* is a function of the dielectric constant and magnetic permeability (a variable) of the ferrite material. Tuning the circuit away from the nominal center frequency therefore has the detrimental effect of causing the degradation of the filter bandwidth characteristics and increasing the filter insertion loss as before mentioned. FIG. 7*a* illustrates a configuration which may be used to extend the useful tuning range of the circuit of FIG. 3*a*. Feedline 26' is elongated, for instance, by making in the U shape shown in FIG. 7*a*. The characteristic impedance, $Z_0$, of feedline 26' is selected to be nearly equal to the external impedance (not shown) which the circuit sees at terminal 20 at a nominal center frequency in the tuning range. At frequencies below nominal center frequency, this $Z_0$ will be greater than the load resistance R. The impedance of FIG. 8, since $Z_0$ changes as the square root of $\mu/\epsilon$ reflected at point 28 is a parallel $R_{MAX}$, L equivalent, illustrated in FIG. 10. At frequencies above nominal center frequency $Z_0$ is less than R and the equivalent load on point 28 is $R_{MIN}$, C as shown in FIG. 9. Since the electrical equivalents of FIGS. 9 and 10 more nearly match the impedance required for optimum filter response at point 28 at the respective frequencies represented by the equivalents, the degradation due to mismatch is much reduced and the net effect is to widen the tuning range of the circuit as shown graphically in FIG. 7*b*. One skilled in the art will understand that there is little degradation at the nominal center frequency range since $Z_0$ is there nearly equal to R and point 28 is therefore still properly loaded with an impedance very nearly equal to R.

It should also be noted that the insertion losses at nominal center frequency are low and relatively constant. The insertion loss may be of the order of 1 d.B. in circuits of this type and the change in insertion loss over the widest tuning range may be less than0.5 d.B. Because the radio frequency voltage gradients encountered in the ferrite substrates of the invention are relatively low, also, the power handling characteristics of the invention are very high, typically in the area of 1000 watts input power.

The tuning range of devices disclosed herein are limited at the low frequency end only by the physical dimensions of the resonator circuits since the resonant frequencies are a function of the electrical dimensions of the resonators, such as 12*a*, 12*b*. At the high frequency end, the tuning range may be limited by occurrence of ferromagnetic resonance of the ferrite material. There is a trade-off between tuning range and nominal operating frequency with wider ranges available at lower frequencies. For example, using typical YIG material ranges of more than 2:1 (one octave) have been accomplished below 600 MHz, while a 25 percent range is usable at 2.2 GHz.

Tuning rate is limited only by the time constant of the magnetic circuit.

Many of the advantages of the present invention may be better understood by consideration of the fact that all of the electronic elements of the tunable circuit are operated within the confines of ferrite substrates 10,14 and they are thus affected by the variation in the magnetic permeability of the ferrite medium with a change in the bias current in coil 2. Of course, magnetic field strength might also be varied by mechanically adjusting permanent magnets.

As stated above, prior art practice included magnetic permeability tuning of inductive elements. If a tuned circuit was desired, it was the practice in the art to locate an associated capacitive element or elements external to the ferrite material, usually in lumped constant (discrete element) form. At least two problems are associated with this prior art practice, voltage arcover at high input power due to high radio frequency electric field intensities, and variations in bandwidth with change in center (or nominal) frequency of operation, are solved in the present invention. In addition, the present invention produces circuits with very low insertion losses which are essentially constant over the total frequency tuning range of the circuit. Further, the use of a ferrite, such as ytrrium-iron-garnet magnetically biased into saturation contributes to the aforementioned low insertion losses due to the inherent low loss characteristics of the material. The material also displays a very high degree of linearity in terms of response at relatively high magnetic field intensities, that is, it has a very high magnetic field saturation level. The material also has good thermal conductivity together with the low magnetic and dielectric loss properties, further contributing to successful high power operation. Another factor contributing to good high power operation is the high Curie temperature of the material; that temperature at which the magnetic characteristics of the material disappear.

The rate of change of magnetic permeability of the ferrite is practically limited only by the ability to change the magnetic field intensity in the magnetic circuit of the invention. Techniques well known in the art, such as lamination of magnetic core 4 and high energy inputs to coil 2 may be used to decrease response time of the magnetic circuit. Operation of the invention at high levels of magnetic field intensity causes the magnetic permeability of the ferrite material to be low.

Due to the properties of the ferrite material, energy loss increases at low magnetic field intensity corresponding to high permeability levels, therefore, operation at low permeability (high magnetic field intensity) is desirable to provide low loss levels and corresponding high power handling capability.

It will be apparent to one skilled in the art that the embodiments of the invention as herein discloses, are capable of providing tunable radio frequency circuit functions at a lower cost and in a more compact form than prior art mechanically tuned systems.

Various other modifications and changes may be made to the present invention from the principles disclosed herein without departing from the spirit and scope thereof, as encompassed in the accompanying claims.

What is claimed is:

1. A tunable high power radio frequency circuit apparatus, comprising in combination:

tuned printed circuit resonant means for providing a radio frequency output in response to an electrical input, said tuned printed circuit resonant means being tuned to a first predetermined range of radio frequency signals, said tuned printed circuit means comprising at least one radio frequency feedline means having a predetermined electrical length, said at least one radio frequency feedline means having a characteristic impedance equal to a predetermined external load impedance at a nominal operating frequency and wherein said characteristic impedance of said at least one feedline means is lower than said external load impedance at an operating frequency higher than said nominal operating frequency and wherein said characteristic impedance of said at least one feedline means is higher than said external load impedance at a frequency lower than said nominal operating frequency;

at least one ferrite substrate means for providing a variable magnetic permeability therein, said at least one ferrite substrate means having two opposed planar surfaces, one of said surfaces having a ground plane disposed thereupon, the other of said opposed planar surfaces being adjacent said tuned printed circuit resonant means; and magnetic circuit means for producing a magnetic biasing field in said at least one ferrite substrate means and for producing a corresponding magnetic permeability in said at least one ferrite substrate means, said magnetic biasing field bing orthogonal to said at least one ferrite substrate means and to said tuned printed circuit resonant means, said tuned printed circuit resonant means being tunable to frequency ranges other than said first predetermined range of radio frequency signals in response to changes in said magnetic biasing field and in said corresponding magnetic permeability in said at least one ferrite substrate means, said characteristic impedance of said feedline means varying by means of said changes in said permeability of said ferrite substrate means.

2. The apparatus according to claim 1 wherein said magnetic biasing means is variable for providing a range of said magnetic biasing fields in said at least one ferrite substrate means, said magnetic biasing field means thus controlling said permeability of said ferrite substrate means within a predetermined range.

3. The apparatus according to claim 2 wherein said at least one ferrite substrate means comprises:

a first ferrite substrate having a ground plane on one side and an ungrounded other side;

a second ferrite substrate having a ground plane on one side and an ungrounded other side, said tuned printed circuit means being adjacent and parallel to said ungrounded other sides of each of said first and said second ferrite substrate means to form a three layer laminate.

4. The apparatus according to claim 3 wherein said tuned printed circuit means is attached to at least one of said ferrite substrates.

5. The apparatus according to claim 3 wherein said tuned printed circuit means is disposed between said first and said second ferrite substrates.

6. The apparatus according to claim 3 wherein said ferrite material substrate means is made of yttrium-iron-garnet.

* * * * *